US006270407B1

(12) United States Patent
Dodge

(10) Patent No.: US 6,270,407 B1
(45) Date of Patent: Aug. 7, 2001

(54) PARTITION KENO GAMES

(75) Inventor: Clifford B. Dodge, Billings, MT (US)

(73) Assignee: Summit Amusement & Distributing, Ltd., Billings, MT (US)

( * ) Notice: Subject to any disclaimer, the term of this patent is extended or adjusted under 35 U.S.C. 154(b) by 0 days.

(21) Appl. No.: 09/364,713

(22) Filed: Jul. 30, 1999

(51) Int. Cl.[7] ..... A63F 9/24
(52) U.S. Cl. ..... 463/18; 463/25; 273/269
(58) Field of Search ..... 463/17, 18, 19, 463/25–28; 273/269, 292

(56) References Cited

U.S. PATENT DOCUMENTS 5,401,024 * 3/1995 Simunek ..... 273/138 A
5,611,729 * 3/1997 Schumacher et al. ..... 463/18
5,651,735 * 7/1997 Baba ..... 463/18
5,813,911 * 9/1998 Margolin ..... 463/19
5,909,875 * 6/1999 Weingardt ..... 273/269
6,102,400 * 8/2000 Scott et al. ..... 273/269
6,183,361 * 2/2001 Cummings et al. ..... 463/18

* cited by examiner

*Primary Examiner*—Mark Sager
*Assistant Examiner*—John M Hotaling, II
(74) *Attorney, Agent, or Firm*—John Edward Roethel

(57) ABSTRACT

A player selects from a keno layout a group of numbered spots, preferably between two and ten numbered spots, which are designated as the player spots. Twenty keno numbers, such as numbered keno balls, are randomly selected from a total keno pool of eighty numbers. The selection of the twenty keno numbers is grouped into a number of partitions, such as four partitions of five keno numbers each. Each keno number selected that matches a player spot is considered a "hit" number. The player must achieve a minimum number of "hits" to receive an award. The amount of the player's award is based on the number of "hits" achieved and the number of cumulative partitions it takes for the player to achieve a winning number of "hits". A pay table is provided that shows the winning match occurrences for each cumulative group of partitions and the player receives the highest award shown in the pay tables for a winning play.

18 Claims, 3 Drawing Sheets

PARTITION KENO GAMES

This invention relates primarily to electronic video keno games, and more particularly to electronic video keno games that allow the player to play a game of keno with the pay tables based on a partition arrangement according to how many keno numbers must be drawn in order for the player to achieve a winning number of hits.

BACKGROUND OF THE INVENTION

Keno is a well known casino game and has been played in both live game format and electronic game format for many years. In conventional keno, there are eighty keno numbers in the pool of numbers that may be drawn in any one round of the game. In the typical live keno game format, eighty keno balls are numbered 1 through 80 and are placed in a air blower device that circulates the keno balls. Twenty of the eighty keno balls are selected each game. Besides air blower devices, other devices that can randomly select numbers from a pool have been used such as electronic random number generators. The twenty numbers selected are typically displayed to the players on an electronic reader board device. The electronic reader board device has a matrix of eight rows with ten columns which shows all eighty possible numbers that may be drawn. As a keno ball is drawn, its corresponding number is illuminated on the electronic reader board device.

In a conventional live keno game format, each player marks a keno ticket that is also an eight by ten matrix having eight rows and ten columns arranged similarly to the electronic reader board device. The keno numbers from one through eighty are printed on the keno ticket. Prior to the start of a round of the keno game, a player selects between one and fifteen numbered spots that the player thinks will be drawn during the game. Typically a player uses a crayon-like pencil to mark the numbered spots he wishes to play on his keno ticket and the player takes his marked keno ticket to a keno station. The player makes an appropriate wager and turns in his marked keno ticket at the keno station. The player receives back a stamped and receipted ticket showing the amount of the player's wager and the numbered spots that the player has selected.

The keno game operator then activates the keno equipment and proceeds to draw twenty numbers from the eighty keno balls. Depending on the number of matches between the twenty numbers drawn and the numbered spots selected by the player, the player wins or loses. The more numbers that match, the higher the payoff to the player.

In a live keno game format, wagers can range from as little as 35¢ a game to $5, $10 or even higher dollars per game. Typically each establishment operating a keno game will provide a group of payout charts showing the amount that it is possible for the player to win based on the amount wagered, the number of numbered spots selected by the player and the number of matches achieved by the player when the twenty keno balls are selected. For example, if the player wagers $1 and selects one number, the player will typically win $3 if his selected numbered spot is one of the twenty numbered keno balls drawn during the play of the game. Similarly, if the player selects fifteen numbers, the player will typically have a winning ticket if anywhere between a total of eight and fifteen of his numbered spots match the twenty numbered keno balls drawn. The highest payout will be made for matching fifteen out of fifteen, with lower payouts made for matching fourteen out of fifteen, thirteen out of fifteen and so on down to eight out of fifteen.

Any matches of seven or less are typically losing plays. Similar payout schemes are provided when the player marks other totals of numbered spots between one and fifteen during any round of a keno game.

When the player plays an electronic video keno gaming machine, a single player plays against the keno gaming machine for each round of the game and the player either wins or loses each round. The player wagers a coin, token or credit and selects the number of numbered spots that the player is attempting to match during that round of the game. All eighty numbers are displayed on a video screen with an eight by ten matrix similar to that of a keno ticket. The numbers are selected by the player using by a light pen, or by pressing the numbers on a selection panel or by touching the numbers selected using conventional touch screen technology.

In the typical electronic keno format, the player may select between one and ten numbered spots to attempt to match. After the player has completed selecting the numbered spots that the player wishes to match and has made the appropriate wager, the player presses the "Start" button. This causes the electronic controls of the gaming machine to randomly select twenty numbers from the pool of eighty numbers and the selected numbers are displayed to the player. The electronic controls of the gaming machine determine whether the player has achieved a winning payout at the conclusion of each round of the game. Just as in live keno, the player wins when he matches all or a predetermined minimum number of his selected numbered spots. If the player matches less than the predetermined minimum number of his selected numbered spots, then the player loses his wager. Payouts are made by accruing credits on the credit meter of the gaming machine or dispensing coins or tokens into a payout tray.

The basic principles of the play of keno are set out in Scarne's New Complete Guide to Gambling, by John Scarne, at pages 490–499.

The mathematical calculations for keno payouts are based on the odds of selecting a particular total of numbered spots when twenty keno numbers are chosen from a pool of eighty numbers. As explained in Scarne's New Complete Guide to Gambling, by John Scarne, at pages 493–499, the odds of ten particular numbers being randomly selected from the twenty numbers drawn out of the pool of eighty numbers is 8,911,710-to-1. The gaming operator then determines what payout percentage he wishes to offer to the player and provides a corresponding pay table. For example, as explained in the Scarne material, based on a percentage return to the player of 79.3%, if the player "hits" ten out of ten numbers, the player can be paid $10,000.00 for a wager of $1.00. Other payout amounts are offered if the player "hits" nine out of ten numbers down to five out of ten numbers and the player loses his wager if the player "hits" four or less numbers out of ten.

Conventional keno, in either the live game format or in the electronic game format, makes no differentiation based on how many selected numbers it takes for the player to achieve a winning event. The player receives the same payout whether the player achieves a winning event in the first few numbers drawn or whether it takes all twenty numbers for the player to achieve the winning event.

In order to increase the popularity of keno and to allow the player to be rewarded with higher payouts, it is an object of the present invention to provide a payout schedule for a keno game in which the amount won by the player is based on both the number of "hits" achieved and also the number of keno balls it takes to achieve the "hits".

It is a feature of the present invention to provide a pay table which is configured into partitions of the total number of keno balls selected during any one round of the game. Each partition is a subset of the total number of keno balls selected. As each subset of keno balls are selected, the numbered spots preselected by the player are analyzed to determine if the player has achieved a winning play. The fewer selected numbers it takes for the player to achieve a winning play, the higher the payout to the player.

It is an advantage of the present invention that another element of chance is added to a game of keno. Besides being rewarded for achieving "hits", the player is also awarded if his "hits" occur early in the progression of the selection of keno balls.

Other objects, features and advantages of the present invention will become apparent from a consideration of the following detailed description.

SUMMARY OF THE INVENTION

A player selects from a keno layout a group of numbered spots, preferably between two and ten numbered spots, which are designated as the player spots. Twenty keno numbers, such as numbered keno balls, are randomly selected from a total keno pool of eighty numbers. The selection of the twenty keno numbers is grouped into a number of partitions, such as four partitions of five keno numbers each. Each keno number selected that matches a player spot is considered a "hit" number. The player must achieve a minimum number of "hits" to receive an award. The amount of the player's award is based on the number of "hits" achieved and the number of cumulative partitions it takes for the player to achieve a winning number of "hits". A pay table is provided that shows the winning match occurrences for each cumulative group of partitions and the player receives the highest award shown in the pay tables for a winning play.

DETAILED DESCRIPTION OF THE PREFERRED EMBODIMENTS

The method of the present invention is played using either a live keno game format or using an electronic keno gaming machine. The description that follows refers to an electronic keno gaming machine, but the same principles of the present invention can be easily adapted to a live keno game format.

Figure 1:
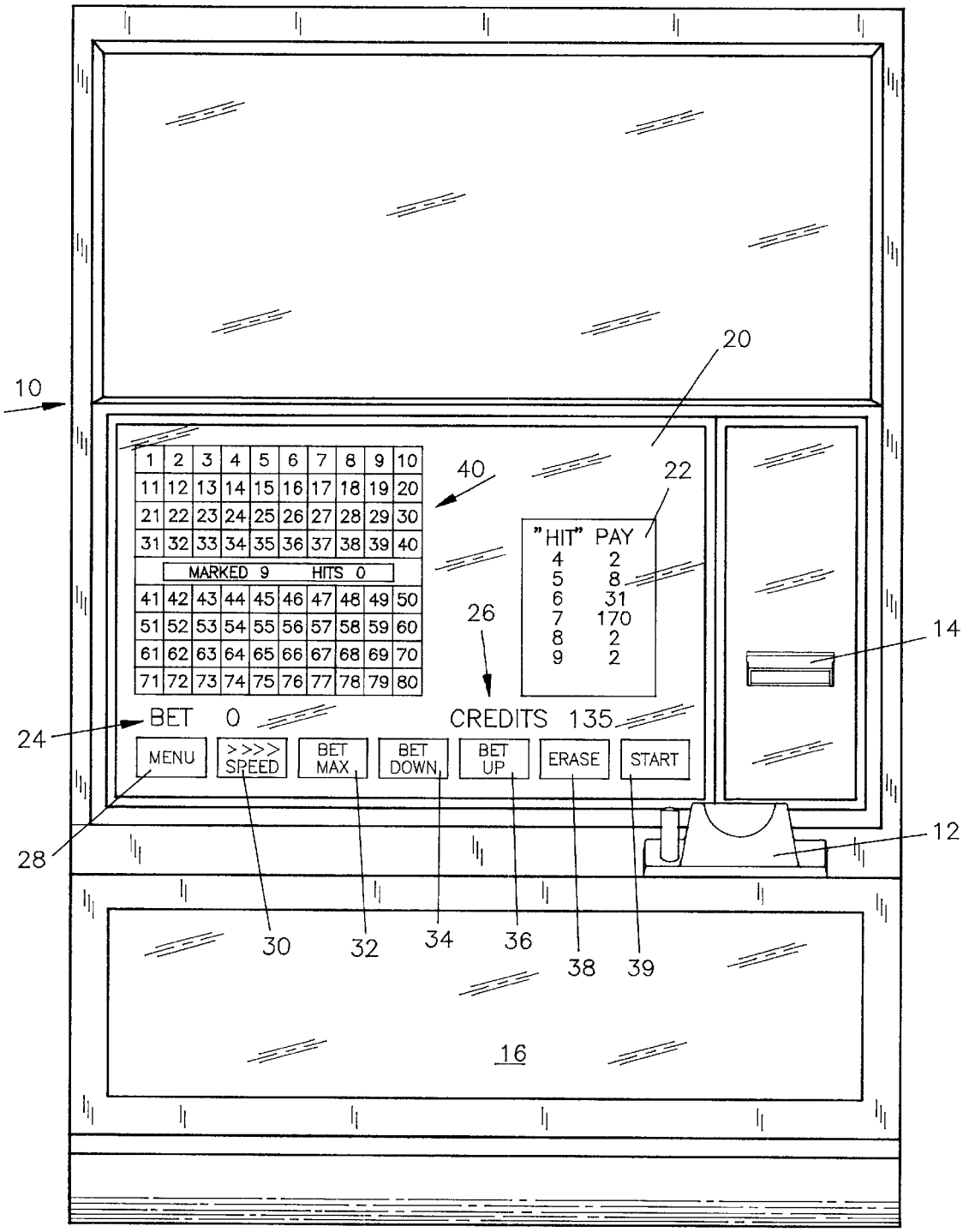
FIG. 1 shows the front view of a an electronic keno gaming machine which can be used to practice the method of the present invention.

FIG. 1 shows an electronic keno gaming machine 10 that is provided with a video screen display 20, a coin head 12 for receiving coins or gaming tokens, a bill acceptor 14 for receiving paper currency, a coin hopper (not shown and mounted on the interior of the gaming machine cabinet) for making payouts into a payout tray 16, a payout table 22 which can be displayed on the video screen display 20 and computer controls (not shown and mounted on the interior of the gaming machine cabinet) to operate the gaming machine.

Also provided are various designated touch screen locations in the form of "buttons" that allow the player to make wagers, start the play of the game and collect winnings. For example, A "MENU" button 28 may be provided to allow the player to access a MENU screen from which the player may select one of a multitude of games, such as the Partition Keno Game that the player is playing. A "SPEED" button 30 can also be provided to allow the player to adjust the speed at which the keno numbers are selected by the computer controls since some players prefer a slower pace of game while other players prefer a quicker pace of play.

A "BET MAX" button 32 is provided to allow the player to choose to wager the maximum number of credits available for this particular game. Also provided are a "BET DOWN" button 34 and a "BET UP" button 36 which the player can use to increment or decrement the amount of the player's wager prior to the start of each round of the game. An "ERASE" button 38 can be used by the player to clear the keno layout 25 of player spots that were selected in the previous game. Finally, a "START" button 39 that is pressed by the player to activate the computer controls to start selecting keno numbers after the player has made his wager and selected the player numbers the player wishes to attempt to match during a round of the game.

Figure 2:
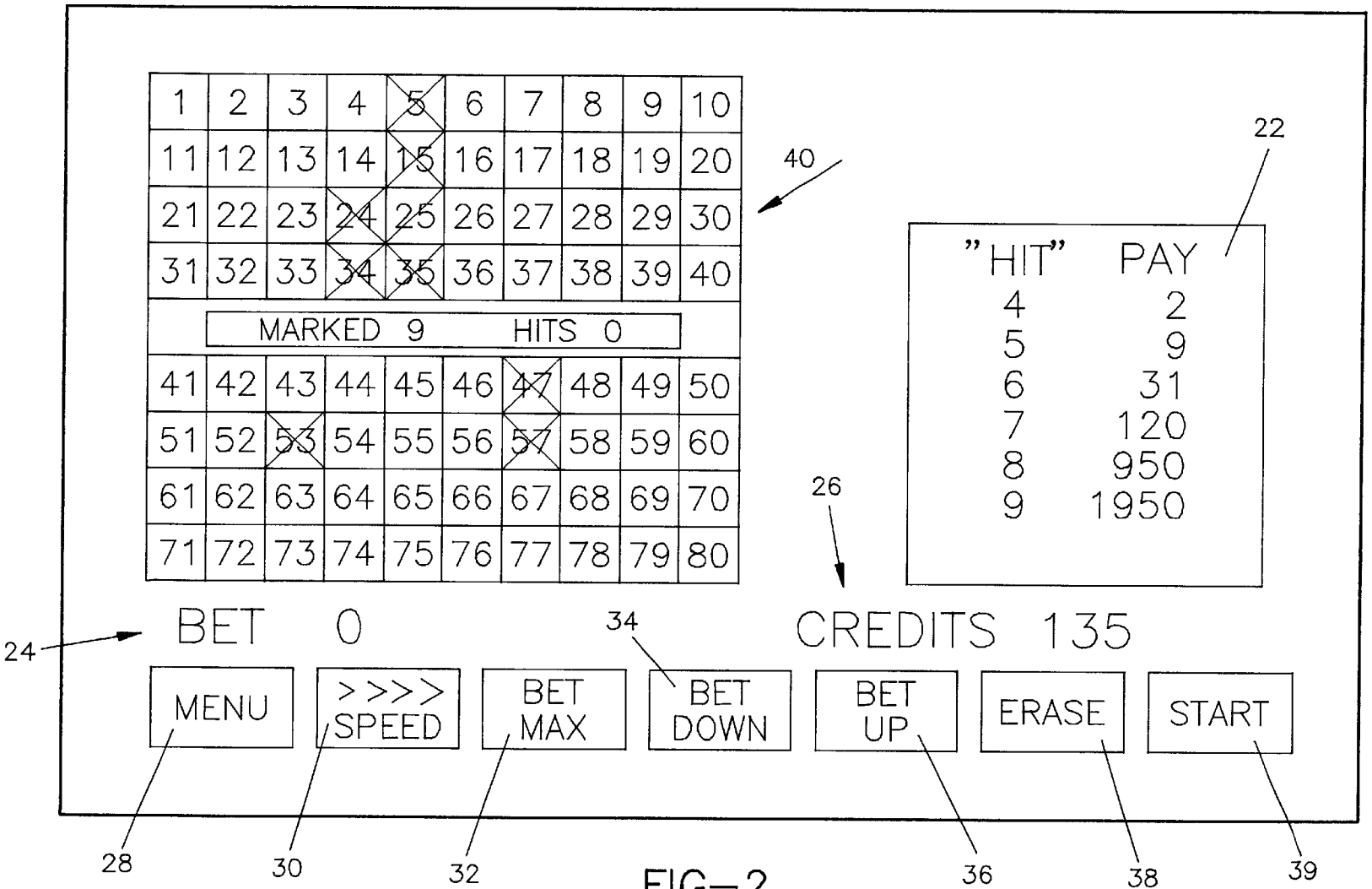
FIG. 2 shows a representative display of the initial video screen display of the method of play of the present invention.

FIG. 2 shows the initial video screen display 20 presented to the player when the player has chosen to play the method of the present invention. The video screen display 20 shows a keno layout 40 in the form of an eight by ten matrix of the eighty numbers which represents the keno ticket to be marked by the player. As is traditional in video keno displays, the keno numbers 1–40 are shown in the top half of the matrix and the keno numbers 41–80 are shown in the bottom half of the matrix. In the center section 42 of the matrix, information is provided to the player showing the quantity of numbered spots marked by the player and the number of "hits" achieved by the player in during the round of the game played. Also provided on the video screen display 20 is a pay table 22 showing the payouts available to the player for achieving the required number of hits which are based on the number of player spots marked by the player.

In the preferred embodiment of the present invention, the player selects the numbered spots he wishes to play during a particular round of the game by using conventional touch screen technology, namely, the player merely touches the numbered spots in the keno layout 40 to select each spot. Preferably, the player selects between two and ten spots for each round of the game. Alternatively the method of the present invention can be practiced with the player choosing as few as one numbered spot or even more than ten numbered spots. Also, other methods of selecting numbered spots can be used such as a light pen or any suitable manner of allowing the player to make his selection.

In the preferred embodiment of the present invention, twenty numbers from the total pool of eighty numbers will be randomly selected by the computer controls of the gaming machine. As each number is selected, the number is shown in any suitable format on the video screen display, such as represented by a ball with the selected number in the center of the ball. The selected numbers are arranged in a group of partitions on the video screen display.

Also, in the preferred embodiment of the present invention, there are four partitioned groups of five numbers each. In other variations of the present invention, the number of partitioned groups can be three or less groups or five or more groups.

FIG. 2 shows as an example of the method of play of the present invention that the player has selected nine numbered spots to be the player spots during a round of the game. The numbered spots selected by the player in this example are 4, 15, 24, 25, 34, 35, 47, 53 and 57. The player spots can be indicated in any suitable manner such as an "X" or by using a color to indicate the spots selected by the player.

Figure 3:
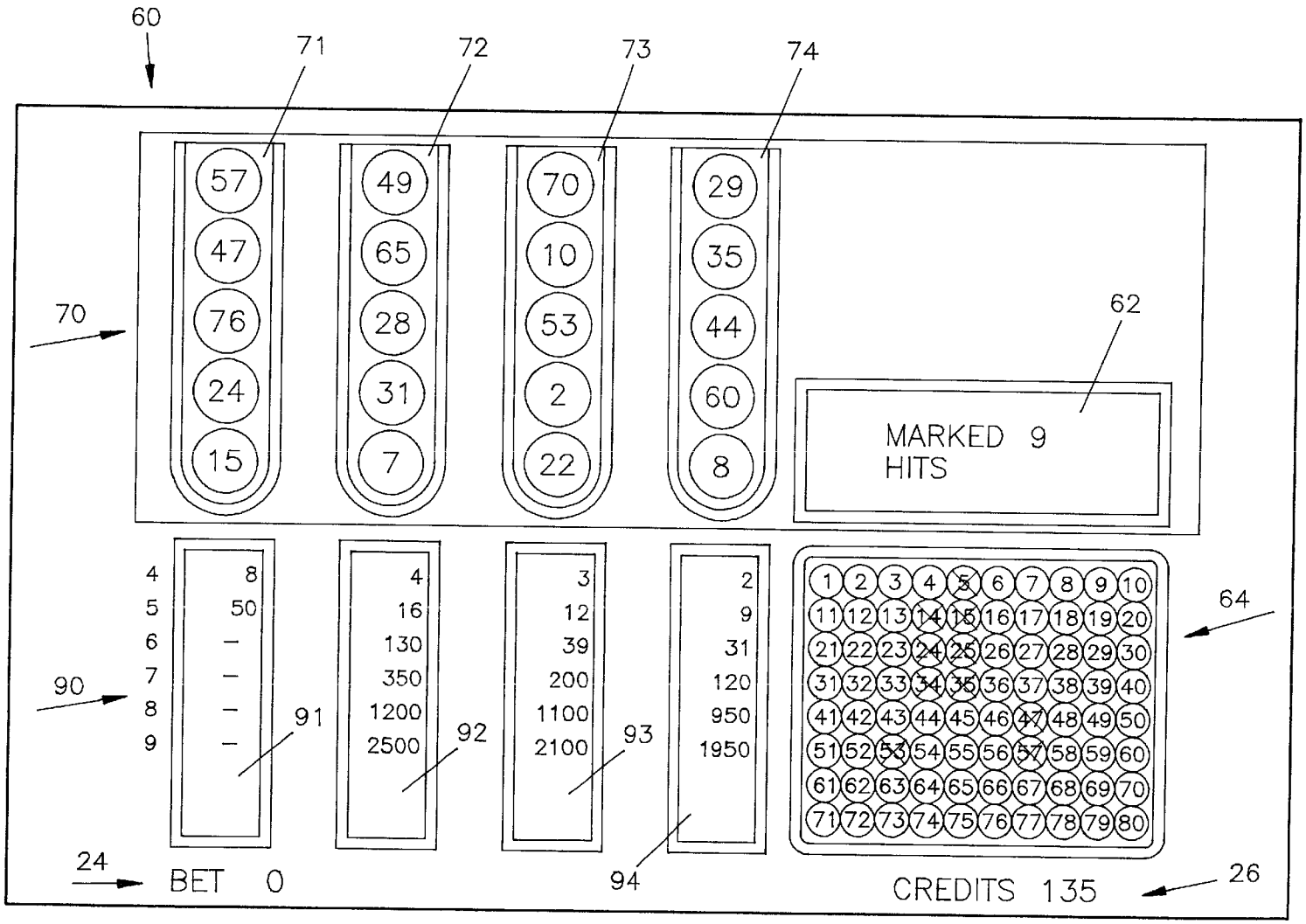
FIG. 3 shows a representative display of a second video screen display used in the method of play of the present invention.

Once the player has made his selection of the numbered spots he wishes to play during that round of the game, the player presses the "START" button 39 and the video screen display changes to the video screen display 60 shown in FIG. 3. FIG. 3 shows an information area 62 which displays to the player how many player spots have been marked by the player and how many "hits" the player has achieved during the play of the game. A keno layout 64 is also shown with all eighty numbers. The player spots are shown with an "X" or other suitable marking such as a color. As the keno numbers are drawn, they are indicated on the keno layout 64 by any suitable indicator such as in bold typeface or with a different color. This provides the player a quick visual display of the results of the game and the number of "hits" achieved by the player.

FIG. 3 also shows in the keno number selection section 70 the four partitions of five numbers each that are used in this embodiment of the present invention. Any suitable manner of displaying the partitions may be used, such as the four vertical partitions shown in FIG. 3. The first partition 71 displays the first five keno numbers chosen. The second partition 72 displays the second five keno numbers chosen. The third partition 73 displays the third five keno numbers chosen. The fourth partition 74 displays the fourth five keno numbers chosen.

The pay table section 90 of the video screen display 60 of FIG. 3 shows four separate pay tables that are associated with the four partitions that are used in the method of play. The first pay table 91 corresponds to the five numbers shown in the first partition 71. The second pay table 92 corresponds to the cumulative ten numbers shown in the first partition 71 and second partition 72. The third pay table 93 corresponds to the cumulative fifteen numbers shown in the first partition 71, the second partition 72 and the third partition 73. The fourth pay table 94 corresponds to the cumulative twenty numbers shown in the first partition 71, the second partition 72, the third partition 73 and the fourth partition 74.

FIG. 3 shows, again by way of example, a representative play of one round of a preferred embodiment of the present invention. The first five keno numbers randomly selected from the total number pool of eighty numbers by the computer controls are placed in the first partition 71 in the video screen display 60. For example, the first group of numbers selected are 15, 24, 76, 47 and 57.

The computer controls then continue to randomly select, from the remaining numbers in the number pool, the second group of five numbers which, in this example, are 7, 31, 28, 65 and 49. This second group of five numbers is shown in the second partition 72 of numbers on the video screen display 60.

A third group of five numbers is then randomly selected by the computer controls from the remaining numbers in the number pool. In this example, the third group of five numbers is 22, 2, 53, 10 and 70. This third group of five numbers is shown in the third partition 73 of numbers on the video screen display 60.

Finally, a fourth of group of five numbers is randomly selected by the computer controls from the remaining numbers in the number pool. Again, by way of example, the fourth group of five numbers is 8, 60, 44, 55 and 29. This fourth group of five numbers is shown in the fourth partition 74 of numbers on the video screen display 60. Thus, a total of twenty numbers has been selected from the eighty number pool.

The nine player spots selected by the player are compared to the numbers randomly selected to determine the number of matches. The matching is done on a cumulative partition basis and the number of matches is looked up in a pay table to determine if the player has achieved a winning play and how much of an award the player is to receive.

Table 1 shows a representative cumulative pay table for a keno game using the method of the present invention. Table 1 is based on nine numbered spots selected by the player and four partitions of five numbers each. The total numbered spots selected by the player is shown on the top while the number of matches ("Hits") is shown on the left.

TABLE 1

| | NINE NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 4 | 8 | 4 | 3 | 2 |
| 5 | 50 | 16 | 12 | 9 |
| 6 | — | 130 | 39 | 31 |
| 7 | — | 350 | 200 | 120 |
| 8 | — | 1200 | 1100 | 950 |
| 9 | — | 2500 | 2100 | 1950 |

With reference to the example discussed above, the nine player spots are first compared to the first partition 71 of five keno numbers that were randomly selected and there are four matches: 15, 24, 47 and 57. Based on the first pay table 91, the player would be awarded eight credits for four "Hits" out of nine player spots in the first partition 71 and the player would receive this award unless the player has earned a higher award for other matching combinations.

The nine player spots are then compared to the combined first partition 71 and second partition 72 of ten keno numbers that were randomly selected and there are still four matches: 15, 24, 47 and 57. Based on the pay table 92, the player would be awarded four credits for four "Hits" out of nine in the combined first and second partitions and the player would receive this award unless the player has earned a higher award for other matching combinations. In this example, the player's award from the first pay table 91 is higher than the player's award from the second pay table 92.

The nine player spots are next compared to the combined first partition 71, second partition 72 and third partition 73 of fifteen keno numbers that were randomly selected and there are now five matches: 15, 24, 47, 53 and 57. Based on the third pay table 93, the player would be awarded twelve credits for five "Hits" out of nine in the combined first, second and third partitions and the player would receive this award unless the player has earned a higher award for other matching combinations.

Finally, the nine player spots are next compared to the combined first partition 71, second partition 72, third partition 73 and fourth partition 74 of twenty keno numbers that were randomly selected and there are now six matches: 15, 24, 35, 47, 53 and 57. Based on the pay table 94, the player would be awarded thirty-one credits for six "Hits" out of nine in the combined first, second, third and fourth partitions and the player would receive this award unless the player has earned a higher award for other matching combinations. In this example, the highest award is the thirty-one credit award which is the award paid to the player.

The payouts shown in Table 1 are for each coin, token or credit wagered and would be multiplied by the numbers of units wagered by the player. Most electronic keno gaming machines allow the player to wager from one to four coins, tokens or credits of whatever the denomination being used on the keno gaming machine, although any number of coins, tokens or credits may be wagered.

Any suitable payout table can be used based on the mathematical odds which the gaming establishment wishes to offer to the player.

The method of the present invention can be applied to other amounts of player spots. In the preferred embodiment of the present invention, the player may chose from two to ten player spots for any round of the game. Suitable pay tables are provided for each amount of player spots chosen by the player.

Table 2 shows a representative pay table that can be used when the player chooses two player spots and four partitions of five numbers each are used.

TABLE 2

| | TWO NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 2 | 44 | 19 | 14 | 11 |

Table 3 shows a representative pay table that can be used when the player chooses three player spots and four partitions of five numbers each are used.

TABLE 3

| | THREE NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 2 | 8 | 5 | 4 | 2 |
| 3 | 81 | 40 | 30 | 26 |

Table 4 shows a representative pay table that can be used when the player chooses four player spots and four partitions of five numbers each are used.

TABLE 4

| | FOUR NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 2 | 4 | 3 | 1 | 1 |
| 3 | 18 | 9 | 8 | 5 |
| 4 | 200 | 80 | 75 | 70 |

Table 5 shows a representative pay table that can be used when the player chooses five player spots and four partitions of five numbers each are used.

TABLE 5

| | FIVE NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 3 | 9 | 7 | 6 | 4 |
| 4 | 110 | 80 | 57 | 20 |
| 5 | 400 | 300 | 200 | 122 |

Table 6 shows a representative pay table that can be used when the player chooses six player spots and four partitions of five numbers each are used.

TABLE 6

| | SIX NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 3 | 8 | 4 | 3 | 2 |
| 4 | 24 | 15 | 13 | 10 |
| 5 | 140 | 80 | 72 | 55 |
| 6 | — | 1600 | 600 | 400 |

Table 7 shows a representative pay table that can be used when the player chooses seven player spots and four partitions of five numbers each are used.

TABLE 7

| | SEVEN NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 3 | 5 | 4 | 3 | 2 |
| 4 | 7 | 6 | 5 | 4 |
| 5 | 36 | 18 | 14 | 10 |
| 6 | — | 200 | 130 | 100 |
| 7 | — | 1250 | 1100 | 950 |

Table 8 shows a representative pay table that can be used when the player chooses eight player spots and four partitions of five numbers each are used.

TABLE 8

| | EIGHT NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 4 | 12 | 5 | 4 | 3 |
| 5 | 60 | 31 | 19 | 15 |
| 6 | — | 300 | 140 | 100 |
| 7 | — | 1600 | 500 | 400 |
| 8 | — | 3200 | 2400 | 1950 |

Table 9 shows a representative pay table that can be used when the player chooses ten player spots and four partitions of five numbers each are used.

TABLE 9

| | TEN NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 4 | 5 | 4 | 3 | 2 |
| 5 | 10 | 7 | 6 | 5 |
| 6 | — | 40 | 14 | 10 |
| 7 | — | 240 | 80 | 60 |
| 8 | — | 500 | 200 | 150 |
| 9 | — | 2000 | 1600 | 1450 |
| 10 | — | 2400 | 2100 | 1950 |

The payouts shown in each Table are for each coin, token or credit wagered and would be multiplied by the number of coins, tokens or credits wagered by the player. Any suitable pay table can be used based on the mathematical odds which the gaming establishment wishes to offer to the player.

It is also possible to use partition groups other than four partitions with five numbers each. For example, there can be ten partitions of two numbers each; five partitions of four numbers each and even two partitions of ten numbers each.

Each type of partition grouping will have its own pay tables based on the number of spots played by the player.

The method of the present invention has been described in connection with the preferred embodiment of four partitions of five numbers each. The pool size of total numbers in the preferred embodiment is eighty numbers with twenty keno numbers being drawn during each round of the game. The player may select between two and ten player numbers in the preferred embodiment.

However, other variations of the present invention may be employed. For example, the method of the present invention can also be applied to total number pool sizes that are larger or smaller than eighty numbers. Likewise the amount of keno numbers randomly drawn by the computer controls can also be more or less than twenty numbers. In these variations, the number of partition groups and the amount of numbers in each partition group can also be varied. Appropriate pay tables for these variation will also be calculated depending on the mathematical odds which the gaming establishment wishes to offer to the player.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a keno game comprising:

a) providing a keno layout displaying a pool of keno numbers;

b) a player selecting a group of the keno numbers as the player's numbered spots;

c) randomly selecting a first partition of keno numbers from the pool of keno numbers and determining the number of matches between the first partition of keno numbers and the player's numbered spots;

d) randomly selecting a second partition of keno numbers from the pool of keno numbers and determining the number of matches between the combined first and second partitions of keno numbers and the player's numbered spots;

e) randomly selecting a third partition of keno numbers from the pool of keno numbers and determining the number of matches between the combined first, second and third partitions of keno numbers and the player's numbered spots; and f) randomly selecting a fourth partition of keno numbers from the pool of keno numbers and determining the number of matches between the combined first, second, third and fourth partitions of keno numbers and the player's numbered spots.

2. The method of claim 1 in which the player makes a wager to participate in the keno game.

3. The method of claim 2 in which the player is paid an award based on the number of matches achieved by the player and based on the amount of the wager made by the player.

4. The method of claim 3 in which the award paid to the player is according to a pay table.

5. The method of claim 4 in which the player in which the pool of keno numbers is eighty numbers and in which the first partition, the second partition, the third partition and the fourth partition each have five keno numbers.

6. The method of claim 5 in which the player selects two numbered spots as the player spots and the pay table is:

| | TWO NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 2 | 44 | 19 | 14 | 11. |

7. The method of claim 5 in which the player selects three numbered spots as the player spots and the pay table is:

| | THREE NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 2 | 8 | 5 | 4 | 2 |
| 3 | 81 | 40 | 30 | 26. |

8. The method of claim 5 in which the player selects four numbered spots as the player spots and the pay table is:

| | FOUR NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 2 | 4 | 3 | 1 | 1 |
| 3 | 18 | 9 | 8 | 5 |
| 4 | 200 | 80 | 75 | 70. |

9. The method of claim 5 in which the player selects five numbered spots as the player spots and the pay table is:

| | FIVE NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 3 | 9 | 7 | 6 | 4 |
| 4 | 110 | 80 | 57 | 20 |
| 5 | 400 | 300 | 200 | 122. |

10. The method of claim 5 in which the player selects six numbered spots as the player spots and the pay table is:

| | SIX NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 3 | 8 | 4 | 3 | 2 |
| 4 | 24 | 15 | 13 | 10 |
| 5 | 140 | 80 | 72 | 55 |
| 6 | — | 1600 | 600 | 400. |

11. The method of claim 5 in which the player selects seven numbered spots as the player spots and the pay table is:

| | SEVEN NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 3 | 5 | 4 | 3 | 2 |
| 4 | 7 | 6 | 5 | 4 |
| 5 | 36 | 18 | 14 | 10 |
| 6 | — | 200 | 130 | 100 |
| 7 | — | 1250 | 1100 | 950. |

12. The method of claim 5 in which the player selects eight numbered spots as the player spots and the pay table is:

| | EIGHT NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 4 | 12 | 5 | 4 | 3 |
| 5 | 60 | 31 | 19 | 15 |
| 6 | — | 300 | 140 | 100 |
| 7 | — | 1600 | 500 | 400 |
| 8 | — | 3200 | 2400 | 1950. |

13. The method of claim 5 in which the player selects nine numbered spots as the player spots and the pay table is:

| | NINE NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 4 | 8 | 4 | 3 | 2 |
| 5 | 50 | 16 | 12 | 9 |
| 6 | — | 130 | 39 | 31 |
| 7 | — | 350 | 200 | 120 |
| 8 | — | 1200 | 1100 | 950 |
| 9 | — | 2500 | 2100 | 1950. |

14. The method of claim 5 in which the player selects ten numbered spots as the player spots and the pay table is:

| | TEN NUMBERED PLAYER SPOTS SELECTED | | | |
|---|---|---|---|---|
| Hits | Partition 1 | Partition 1 + 2 | Partition 1 + 2 + 3 | Partition 1 + 2 + 3 + 4 |
| 4 | 5 | 4 | 3 | 2 |
| 5 | 10 | 7 | 6 | 5 |
| 6 | — | 40 | 14 | 10 |
| 7 | — | 240 | 80 | 60 |
| 8 | — | 500 | 200 | 150 |
| 9 | — | 2000 | 1600 | 1450 |
| 10 | — | 2400 | 2100 | 1950. |

15. A method of playing a keno game comprising:

a) providing a keno layout displaying a pool of keno numbers;

b) a player selecting a group of the keno numbers as the player's numbered spots;

c) randomly selecting a first partition of keno numbers from the pool of keno numbers and determining the number of matches between the first partition of keno numbers and the player's numbered spots; and d) randomly selecting at least a second partition of keno numbers from the pool of keno numbers and determining the number of matches between the combined first and second partitions of keno numbers and the player's numbered spots.

16. The method of claim 15 in which the player makes a wager to participate in the keno game.

17. The method of claim 16 in which the player is paid an award based on the number of matches achieved by the player and based on the amount of the wager made by the player.

18. The method of claim 17 in which the award paid to the player is according to a pay table.

* * * * *